US006023857A

United States Patent [19]

Vizy et al.

[11] Patent Number: 6,023,857

[45] Date of Patent: Feb. 15, 2000

[54] SHOE WITH REMOVABLE MIDSOLE

[75] Inventors: Anthony Dylan Vizy, Marblehead, Mass.; David M. Collins, Rye, N.H.

[73] Assignee: Converse Inc., North Reading, Mass.

[21] Appl. No.: 09/158,352

[22] Filed: Sep. 21, 1998

[51] Int. Cl.[7] ..... A43B 13/12; A43B 13/18

[52] U.S. Cl. ..... 36/30 R; 36/28

[58] Field of Search ..... 36/25 R, 30 R, 36/28, 43, 81

[56] References Cited

U.S. PATENT DOCUMENTS

| | | | |
|---|---|---|---|
| D. 220,464 | 4/1971 | Hayashi . | |
| D. 281,115 | 10/1985 | Campbell et al. | D2/309 |
| D. 292,784 | 11/1987 | Autry | D2/312 |
| D. 296,379 | 6/1988 | Lee | D2/309 |
| D. 303,869 | 10/1989 | Jacobs | D2/310 |
| D. 367,754 | 3/1996 | James | D2/912 |
| 2,265,869 | 12/1941 | Scholl | 36/81 |
| 2,505,773 | 5/1950 | Howe | 36/81 |
| 3,768,182 | 10/1973 | Powers | 36/54 X |
| 4,084,333 | 4/1978 | Del Vecchio | 36/43 |
| 4,316,332 | 2/1982 | Giese et al. | 36/28 |
| 4,541,186 | 9/1985 | Mulvihill | 36/114 |
| 4,592,154 | 6/1986 | Oatman | 36/114 |
| 4,905,382 | 3/1990 | Lin | 36/28 |
| 4,955,147 | 9/1990 | Bos | 36/28 X |
| 5,042,174 | 8/1991 | Nichols | 36/30 R X |
| 5,632,103 | 5/1997 | Suenaga | 36/28 |

*Primary Examiner*—B. Dayoan
*Attorney, Agent, or Firm*—Howell & Haferkamp, L.C.

[57] ABSTRACT

A shoe including an outsole, an upper and a midsole. The outsole has a bottom surface with a central section. The upper has a base portion defined by a bottom peripheral edge of the upper. The upper is secured directly to the outsole around substantially the entire bottom peripheral edge. The midsole is positioned within an interior of the upper above the base portion of the upper. The shoe has a median sole thickness defined by the median distance between a top surface of the midsole and a bottom surface of the outsole. The midsole has a median midsole thickness defined by the median distance between the top surface of the midsole and a bottom surface of the midsole. The median midsole thickness is at least half the median sole thickness.

19 Claims, 4 Drawing Sheets

SHOE WITH REMOVABLE MIDSOLE

BACKGROUND OF THE INVENTION

This invention relates to shoes and, more particularly, to athletic shoes having internal midsoles.

A typical athletic shoe includes a durable rubber outsole, a midsole overlying the outsole, an upper secured to a top surface of the midsole, and a thin sock liner (insole) inside the upper. The midsole is generally made of a resilient foam material, such as ethylene vinyl acetate (EVA) or polyurethane (PU), which provides cushioning and support to the shoe wearer's foot. Typically, construction of the upper involves stitching and gluing together multiple pieces of leather and textiles that constitute the upper. Typically, the upper includes a flat, thin, relatively rigid lasting board that defines the bottom surface of the upper. Formation of the upper (referred to in the art as "lasting") allows the upper to take the approximate shape of the shoe wearer's foot. The lasting board is designed to maintain the proper bottom dimensions of the upper during the lasting process. After the upper has been lasted, it is cemented or otherwise bonded to an upper surface of the midsole. A lower surface of the midsole is cemented or otherwise bonded to an upper surface of the outsole. Finally, a sock liner or insole is placed into the interior of the upper on top of the lasting board. The sock liner is usually necessary for comfort because, without it, the shoe wearer's foot would rest directly on the rigid lasting board.

A disadvantage of many prior art athletic shoes is that, over time, the midsoles become worn rather quickly through compaction of the foam material. This greatly reduces the cushioning capacity of the shoe since the midsole is most often the primary cushioning component in athletic footwear. EVA midsoles may compress to as little as 50% of their original thickness after shoes have been worn for less than a month. It is then necessary to replace to entire shoe if optimum performance is desired since the midsoles are cemented or otherwise bonded to the other components of the shoe.

Another disadvantage of many prior art athletic shoes is that there is no opportunity for customization. Midsoles that provide adequate shock absorption for one shoe wearer may fail to provide adequate shock absorption for a heavier shoe wearer. Also, midsoles that provide adequate shock absorption for a shoe wearer in one type of activity may be inappropriate for another type of activity. Accordingly, there is a need for an athletic shoe having a construction that enables the shoe wearer to remove and replace the midsole of the shoe.

SUMMARY OF THE INVENTION

It is an object of the present invention to provide a shoe having a construction that enables the shoe wearer to remove and replace the midsole of the shoe. Another object is to provide a shoe that can be customized to achieve optimal cushioning characteristics that fit the shoe wearer's particular needs. A further object is to provide a shoe having a construction that enables replacement of worn cushioning components.

In general, a shoe of the present invention comprises an outsole, an upper and a midsole. The outsole has a bottom surface with a central section. The upper has a base portion defined by a bottom peripheral edge of the upper. The upper is secured directly to the outsole around substantially the entire bottom peripheral edge. The midsole is positioned within an interior of the upper above the base portion of the upper. The midsole has a forward end and a rearward end spaced from the forward end. The midsole has a medial side edge and a lateral side edge spaced laterally from the medial side edge. The medial and lateral side edges extend from the rearward end of the midsole to the forward end of the midsole. The midsole has a centerline defined by the locus of points midway between the medial side edge and the lateral edge as the medial and lateral side edges extend from the rearward end of the midsole to the forward end. The midsole has a medial side region adjacent the medial side edge, a lateral side region adjacent the lateral side edge, and a central region between the medial and lateral side regions. The medial side region, lateral side region and central region each extend from the rearward end of the midsole to the forward end of the midsole.

The width of the central region intersected by any plane perpendicular to the centerline is equal to the width of the medial side region intersected by such plane and equal to the width of the lateral side region intersected by such plane. The central region of the midsole has a top surface and a bottom surface. The top and bottom surfaces of the central region extend from the rearward end of the midsole to the forward end of the midsole. The central section of the bottom surface of the outsole is generally co-extensive with the central region of the midsole.

The shoe has a median sole thickness defined by the median distance between the top surface of the central region of the midsole and the central section of the bottom surface of the outsole. The central region of the midsole has a median midsole thickness defined by the median distance between the top surface of the central region of the midsole and the bottom surface of the central region of the midsole. The median midsole thickness is at least half the median sole thickness.

In another aspect of the present invention, a shoe comprises an outsole, an upper, a midsole and a heel counter. The upper is secured directly to the outsole around substantially the entire bottom peripheral edge of the upper. The midsole is positioned within an interior of the upper. The midsole has a forward end and a rear end spaced from the forward end. The heel counter extends upwardly from a portion of the rearward end of the midsole. The heel counter is adapted for cradling the shoe wearer's heel when the shoe wearer is wearing the shoe. The midsole and the heel counter are integral with one another.

In yet another aspect of the present invention, a shoe comprises an outsole, an upper and a midsole. The upper has a base portion defined by a bottom peripheral edge of the upper. The upper is secured directly to the outsole around substantially the entire bottom peripheral edge. The midsole is positioned within an interior of the upper above the base portion of the upper. The midsole has a forward end and a rearward end spaced from the forward end. A portion of the midsole is visible from the exterior of the shoe via a window in a sidewall of the upper.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
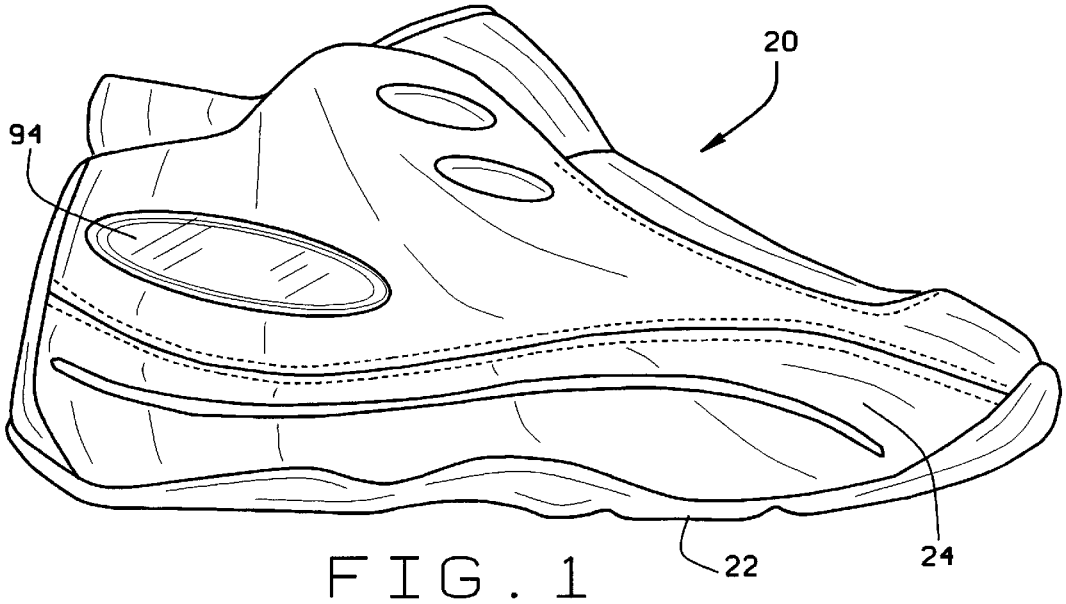
FIG. 1 is a side elevational view of a shoe of the present invention.
Figure 2:
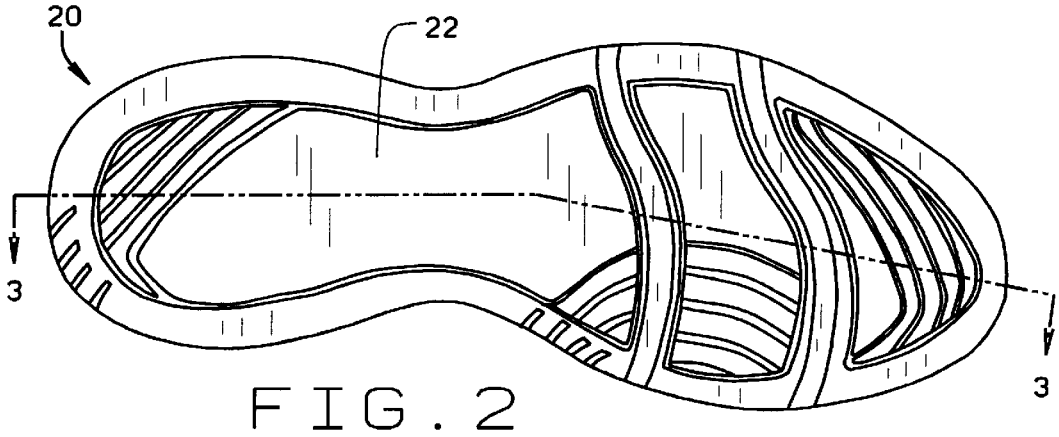
FIG. 2 is a bottom plan view of the shoe of FIG. 1.

A shoe of the present invention is represented in its entirety by the reference numeral 20 in FIG. 1. FIGS. 3–6 show detail of the various components of the shoe. The shoe 20 generally includes an outsole 22, an upper 24 and a midsole 26.

Figure 4:
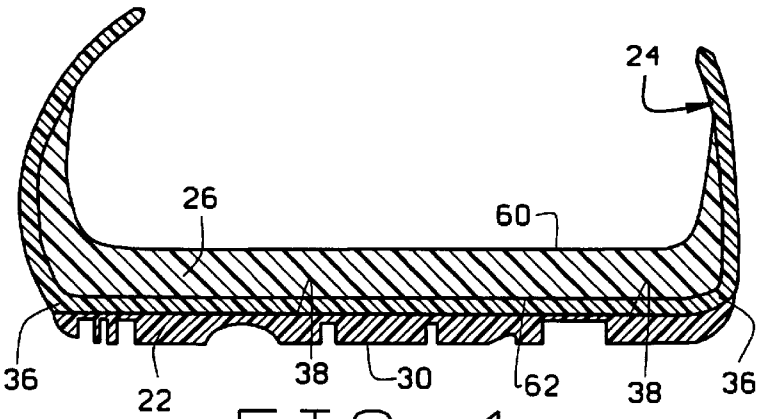
FIG. 4 is a fragmented, cross-sectional view taken along the plane of line 4—4 of FIG. 3 showing detail of the sole of the shoe.

The outsole 22 has a bottom surface 30. Preferably, the outsole 22 is of a durable but resilient material, such as rubber, that provides good traction for the shoe wearer. As illustrated in FIG. 4, the bottom surface 30 of the outsole 22 may include an arrangement of grooves and channels. In addition to ornamentality, such grooves and channels provide improved traction. The use of such grooves and channels in the outsoles of athletic footwear is known in the art.

The upper 24 is preferably constructed of multiple pieces of leather and textiles that are stitched and/or glued together. The upper 24 is lasted so that it takes the approximate shape of the shoe wearer's foot. Preferably, the upper 24 includes a relatively rigid lasting board (not shown) that defines a generally horizontal base portion of the upper 24. The base portion has a bottom peripheral edge 36 that has the approximate shape of an outline of the bottom of the shoe wearer's foot. As shown in FIGS. 3–6, the upper 24 is secured directly to the outsole 22 around substantially the entire bottom peripheral edge 36. Unlike a typical athletic shoe, the upper 24 is cemented, or otherwise fixed, directly to a top surface 38 of the outsole 22.

Figure 3:
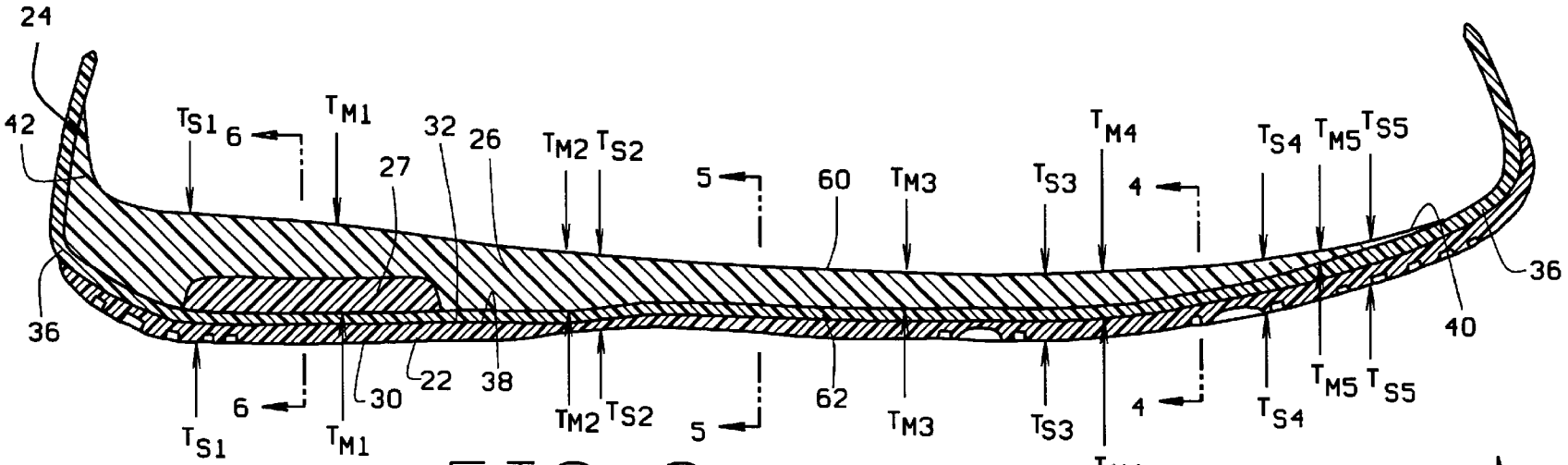
FIG. 3 is a fragmented, cross-sectional view taken along the plane of line 3—3 of FIG. 2 showing detail of the sole of the shoe.
Figure 5:
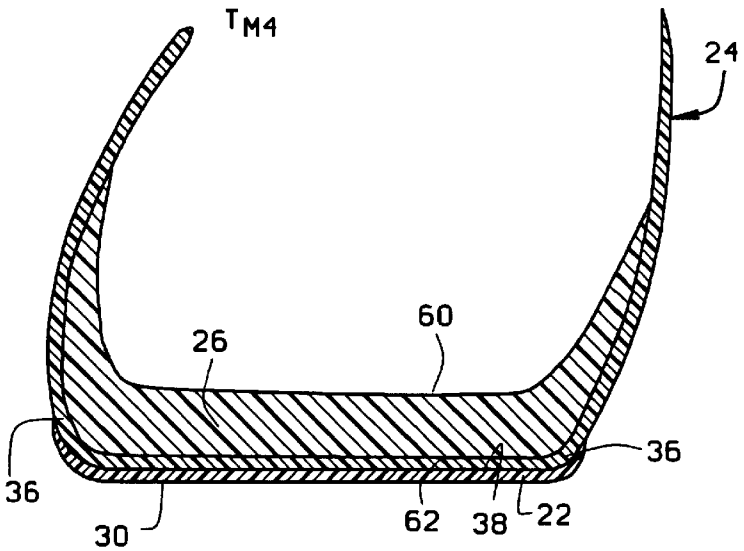
FIG. 5 is a fragmented, cross-sectional view taken along the plane of line 5—5 of FIG. 3 showing detail of the sole of the shoe.
Figure 6:
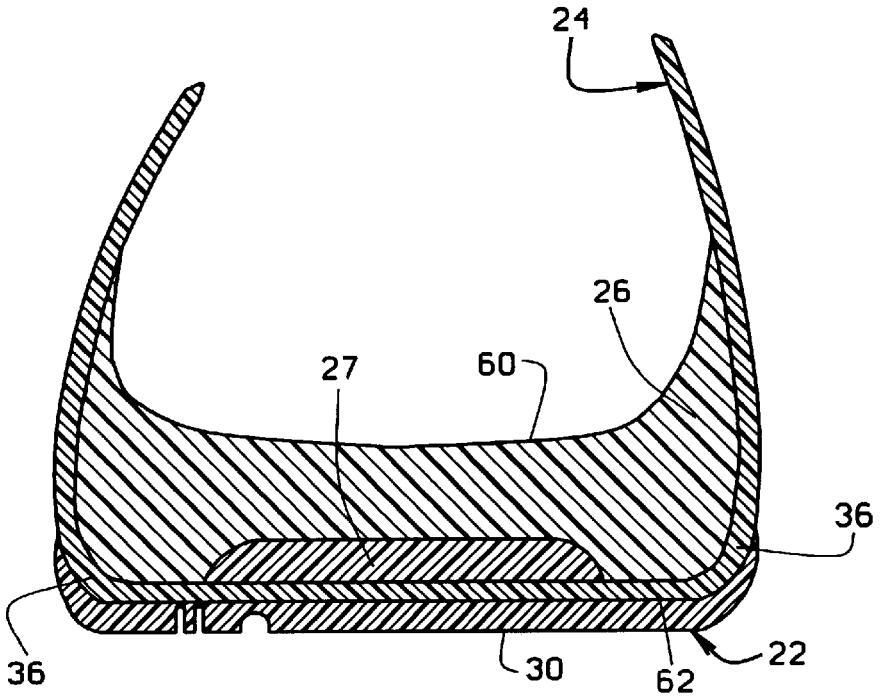
FIG. 6 is a fragmented, cross-sectional view taken along the plane of line 6—6 of FIG. 3 showing detail of the sole of the shoe.

The midsole 26 is preferably made of a resilient material, such as ethylene vinyl acetate (EVA) or polyurethane (PU), which provides cushioning and support to the shoe wearer's foot. However, other resilient materials exhibiting similar cushioning and supporting characteristics could be used without departing from the scope of the invention. As with typical athletic shoes, due to its resiliency and compressibility, the midsole 26 serves as the primary cushioning component of the shoe 20 of the present invention. However, unlike prior art athletic shoes, the midsole 26 in the shoe 20 of the present invention is positioned within an interior of the upper 24 above the base portion of the upper. Preferably, the midsole 26 is not bonded to the upper 24 or outsole 22, thus enabling removal of the midsole 26 from the interior of the upper 24 (see FIG. 9). As shown in FIGS. 3 and 6, the midsole 26 may include a resilient member 27 in the heel area. In other embodiments, the midsole may include a similar resilient member in the forefoot area of the shoe. The resilient member 27 may be made of a material that exhibits characteristics of cushionability and support that are different from the rest of the midsole 26. The use of various types of resilient inserts adds another opportunity for customization of the shoe. The resilient member 27 may be of a more resilient or less resilient material than the midsole 26 and may comprise a fluid filled bladder. Alternatively, the midsole 26 may include no such resilient member.

The upper 24 is sized to accommodate insertion of the midsole 26 therein. The upper 24 is deeper than typical athletic shoe uppers because it extends down to the outsole, rather that just to the top of the midsole. When constructing the upper 24, a special last is uscd that incorporates the basic shape of the foot. In addition, an allowance is added to the bottom of the last to account for the dimensions of the internal midsole 26. As explained below in more detail, the thickness of the midsole 26 is at least half the total thickness of the sole of the shoe 20.

Figure 7:
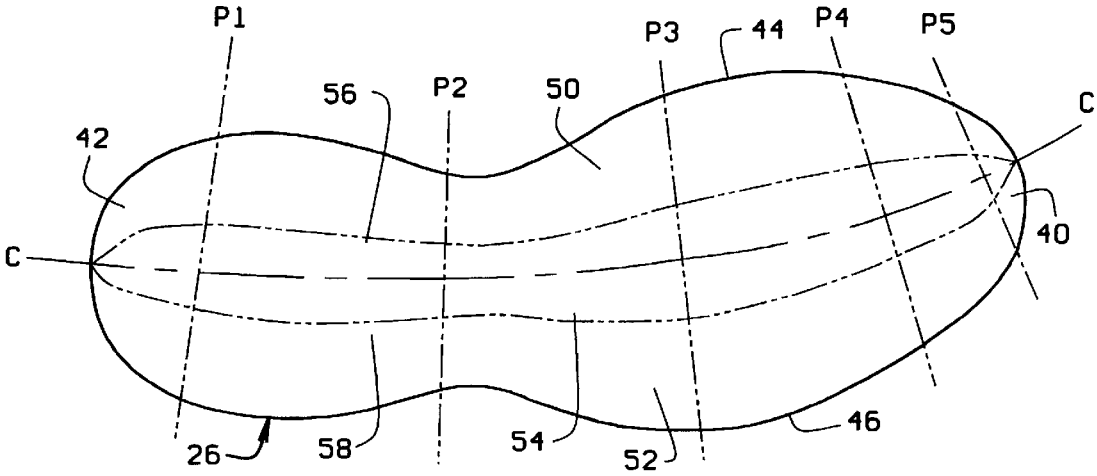
FIG. 7 is a top view of a midsole of the shoe of the present invention.

As shown in FIG. 7, the midsole 26 has a forward end 40 and a rearward end 42. The midsole 26 has a medial side edge 44 and a lateral side edge 46 spaced laterally from the medial side edge 44. The medial and lateral side edges 44 and 46 extend from the rearward end 42 of the midsole 26 to the forward end 40. The midsole 26 has a centerline represented by the letter C in FIG. 7. The centerline C extends from the rearward end 42 of the midsole 26 to the forward end 40. The centerline C is defined by the locus of points positioned midway between the medial side edge 44 and the lateral edge 46 as the medial and lateral side edges extend from the rearward end 42 of the midsole 26 to the forward end 40.

As shown in FIG. 7, the midsole 26 includes three regions: a medial side region 50, a lateral side region 52 and a central region 54. In FIG. 7, the borders of these regions are represented by dashed lines 56 and 58. The medial side region 50 is adjacent the medial side edge 44. The lateral side region 52 is adjacent the lateral side edge 46. The central region 54 is positioned between the medial and lateral side regions 50 and 52. The medial side region 50, lateral side region 52 and central region 54 each extend from the rearward end 42 of the midsole 26 to the forward end 40.

The reference characters P1, P2, P3, P4 and P5 in FIG. 7 represent planes that are perpendicular to the centerline C. The width of the central region 54 intersected by any plane perpendicular to the centerline C is equal to the width of the medial side region 50 intersected by such plane and equal to the width of the lateral side region 52 intersected by such plane. The central region 54 of the midsole 26 has a top surface 60 and a bottom surface 62 (see FIGS. 3–6). The top surface 60 and bottom surface 62 of the central region 54 extend from the rearward end 42 of the midsole 26 to the forward end 40. The bottom surface 30 of the outsole 22 includes a central section that is generally co-extensive with the central region 54 of the midsole 26.

The reference characters $T_{S1}$, $T_{S2}$, $T_{S3}$, $T_{S4}$ and $T_{S5}$ in FIG. 3 represent the total sole thickness at various locations measured from the top surface 60 of the central region 54 of the midsole 26 to the central section of the bottom surface 30 of the outsole 26 at each location. A median sole thickness Ts of the shoe 20 is defined by the median distance between the top surface 60 of the central region 54 of the midsole 26 and the central section of the bottom surface 30 of the outsole 26.

The reference characters $T_{M1}$, $TM_2$, $T_{M3}$, $T_{M4}$ and $T_{M5}$ in FIG. 3 represent the thickness of the midsole 26 at various locations measured from the top surface 60 of the central region 54 of the midsole 26 to the bottom surface 62 of the central region 54 of the midsole 26 at each location. A median midsole thickness $T_M$ is defined by the median distance between the top surface 60 of the central region 54 of the midsole 26 and the bottom surface 62 of the central region 54 of the midsole 26. The median midsole thickness $T_M$ is at least half the median sole thickness $T_S$. More preferably, the median midsole thickness $T_M$ is at least 60% of the median sole thickness $T_S$. Preferably, the median midsole thickness $T_M$ is at least about 10 millimeters. More preferably, the median midsole thickness $T_M$ is at least about 15 millimeters.

In another aspect of the present invention, a mean sole thickness is defined by the mean distance between the top surface 60 of the central region 54 of the midsole 26 and the central section of the bottom surface 30 of the outsole 26, and a mean midsole thickness is defined by the mean distance between the top surface 60 of the central region 54 of the midsole 26 and the bottom surface 62 of the central region 54 of the midsole 26. Preferably, the mean midsole thickness is at least half the mean sole thickness. More preferably, the mean midsole thickness is at least 60% of the mean sole thickness. Preferably, the mean midsole thickness is at least about 10 millimeters. More preferably, the median midsole thickness is at least about 15 millimeters.

Figure 8:
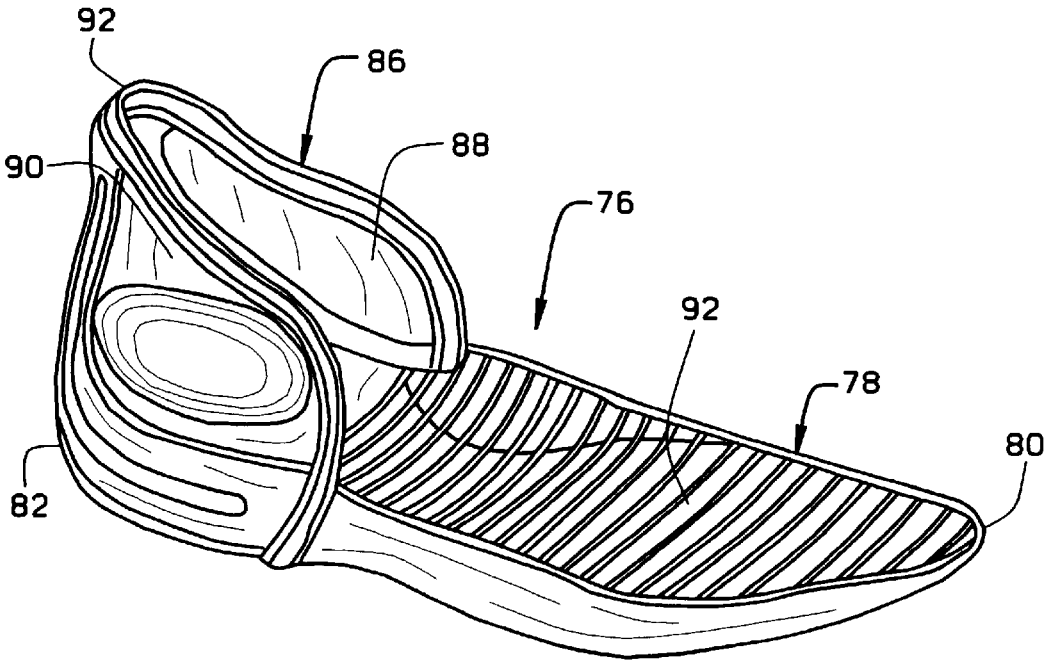
FIG. 8 is a perspective view of another embodiment of a midsole of the shoe of the present invention.

An alternative embodiment of a midsole of the present invention is represented in its entirety by the reference numeral 76 in FIG. 8. Other than what is described hereinafter and shown in FIG. 8, the discussion with respect to FIGS. 1 through 7 is applicable to the embodiment 76 shown in FIG. 8. The midsole 76 has a base portion 78 with a forward end 80 and a rearward end 82. The base portion 78 of the midsole 76 is similar in most respects to the midsole 26 described above and shown in FIGS. 3–7. The midsole 76 includes a heel counter 86, which extends upwardly from the rearward end 82 of the base portion 78. Preferably, the heel counter 86 includes a pair or laterally spaced sidewalls 88 and 90 and a posterior wall 92, that extend from the periphery of the rearward end 82 of the base portion 78, so that the heel counter 86 has a generally U-shaped configuration, when viewed from above. The heel counter 86 is adapted for "cradling" the shoe wearer's heel when the shoe wearer is wearing the shoe. In particular, the heel counter 86 supports the shoe wearer's heel in the posterior, medial, and lateral aspects.

Figure 9:
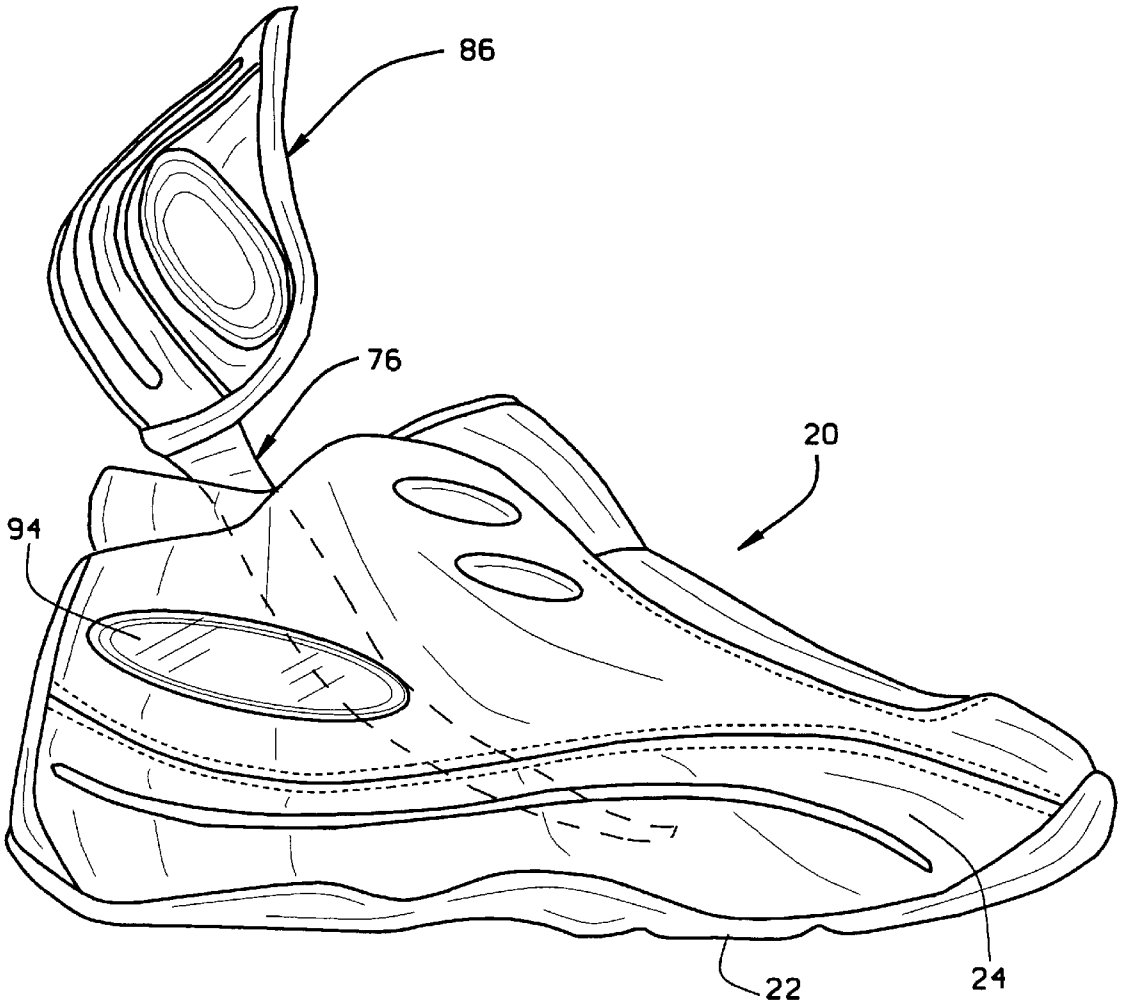
FIG. 9 is a side clevational view similar to FIG. 1 illustrating the removability of the midsole of FIG. 8.

Like the midsole 26 discussed above, the midsole 76 of this embodiment is positioned within an interior of the upper 24 above the base portion of the upper. Preferably, the midsole 76 is not bonded to the upper 24 or outsole 22, thus enabling removal of the midsole 76 from the interior of the upper 24. FIG. 9 illustrates the removability of the midsole 76 from the shoe. As shown in FIG. 9, the midsole 76 can be inserted or removed from through the opening in the top of the shoe.

Although the use of heel supporting structures per se is known in the art, in typical prior art athletic shoes, a rigid heel supporting structure is incorporated into the lining of the upper in the region of the upper that wraps around the shoe wearer's heel. Unlike these prior art athletic shoes, the heel counter 86 of the present invention is integral with the base portion 78 of the midsole 76. Because it is incorporated directly onto the removable midsole 76, the heel counter 86 of the present invention is closer to the shoe wearer's heel than prior art heel supporting structures, and therefore has a greater affect on heel stabilization. Unlike prior art heel supporting structures that are incorporated into the lining of the upper, the heel counter 86 of the present invention is preferably in direct contact with the shoe wearer's heel.

Preferably, the heel counter 86 includes a rigid core member (not shown), which is surrounded or enveloped by the same resilient material that the base portion 78 is made from, e.g., EVA or PU. The rigid core member has a generally U-shaped configuration that is adapted to surround the shoe wearer's heel. Preferably, the rigid core member is made from a rigid plastic material, such as SURLYN®, nylon, or PVC. Of course, the rigid core member could be made of other rigid materials exhibiting similar mechanical characteristics without departing from the scope of the invention. The preferred hardness for the rigid core member is about 65 shore A. The resilient envelope of the heel counter 86 surrounds the rigid core member and provides both cushioning and support to the shoe wearer's foot. The resilient envelope of the heel counter 86 provides comfort by keeping the shoe wearer's heel from rubbing directly against the rigid core member.

The midsole 76 could be constructed as a single molded component or two molded components that are then cemented or otherwise bonded to one another. Preferably, the heel counter 86 and the base portion 78 are of a unitary (monolithic) one-piece construction that is removable from the interior of the upper 24. In the embodiment discussed above having a heel counter 86 with a rigid core member, the rigid core member is inserted into the mold for the midsole 76 during the molding process, and the same resilient foam material that is used to form the base portion 78, e.g., EVA or PU, is molded around the rigid core member to form the heel counter 86.

In another aspect of the present invention, a portion of the midsole 76 is visible from the exterior of the shoe 20 via a window 94 (see FIG. 1) in a sidewall of the upper 24. Preferably, a portion of the heel counter 86 is visible from the exterior of the shoe 20 via the window 94. As shown in FIG. 1, the window 94 is preferably positioned in the upper generally in the area of the shoe wearer's ankle.

Unlike typical prior art athletic shoes, the shoe 20 of the present invention does not require a sock liner or insole. In typical prior art athletic shoes, a sock liner is necessary because, without it, the shoe wearer's foot would rest on the rigid lasting board. In the shoe 20 of the present invention, the lasting board (not shown) lies underneath the removable midsole insert 26 (or underneath the base portion 78 of the midsole 76). Thus, in the shoe 20 of the present invention, the shoe wearer's foot rests on the midsole 26 (or 76) allowing for maximum cushioning and pressure distribution. As shown in FIG. 8, the top surface 92 of the base portion 78 of the midsole 76 is anatomically shaped to match the bottom of the shoe wearer's foot, thereby accentuating the pressure distribution properties of the midsole 76.

In view of the above, it will be seen that the objects of the invention have been achieved and other advantageous results attained. Although the above description is of the preferred embodiments of the shoe of the present invention, other alternative embodiments could be provided without departing from the scope of the invention. As various changes could be made without departing from the scope of the invention, it is intended that all matter contained in the above description or shown in the accompanying drawings shall be interpreted as illustrative and not in a limiting sense.

What is claimed is:

1. A shoe comprising:

an outsole having a bottom surface with a central section;

an upper having a base portion defined by a bottom peripheral edge of the upper, the upper being secured directly to the outsole around substantially the entire bottom peripheral edge; and a midsole positioned within an interior of the upper above the base portion of the upper, the midsole having a forward end and a rearward end spaced from the forward end, the midsole having a medial side edge and a lateral side edge spaced laterally from the medial side edge, the medial and lateral side edges extending from the rearward end of the midsole to the forward end of the midsole, the midsole having a centerline defined by a locus of points midway between the medial side edge and the lateral side edge with the medial and lateral side edges extending from the rearward end of the midsole to the forward end of the midsole, the midsole having a medial side region adjacent the medial side edge, a lateral side region adjacent the lateral side edge, and a central region between the medial and lateral side regions, the medial side region, lateral side region and central region each extending from the rearward end of the midsole to the forward end of the midsole, a width of the central region intersected by any plane perpendicular to the centerline being equal to a width of the medial side region intersected by such plane and equal to a width of the lateral side region intersected by such plane, the central region of the midsole having a top surface and a bottom surface, the top and bottom surfaces of the central region extending from the rearward end of the midsole to the forward end of the midsole, the central section of the bottom surface of the outsole being generally co-extensive with the central region of the midsole;

the shoe having a median sole thickness defined by the median distance between the top surface of the central region of the midsole and the central section of the bottom surface of the outsole;

the central region of the midsole having a median midsole thickness defined by the median distance between the top surface of the central region of the midsole and the bottom surface of the central region of the midsole, the median midsole thickness being at least half the median sole thickness;

the midsole including a heel counter extending upwardly from a portion of rearward end of the midsole, the heel counter being adapted for cradling the shoe wearer's heel when the shoe wearer is wearing the shoe.

2. The shoe of claim 1 wherein the median midsole thickness is at least 60% of the median sole thickness.

3. The shoe of claim 1 wherein a first mean thickness is defined by the mean distance between the top surface of the central region of the midsole and the central section of the bottom surface of the outsole, and wherein a second mean thickness is defined by the mean distance between the top surface of the central region of the midsole and the bottom surface of the central region of the midsole, the second mean thickness being at least half the first mean thickness.

4. The shoe of claim 3 wherein the second mean thickness is at least 60% of the first mean thickness.

5. The shoe of claim 1 wherein the median midsole thickness is at least 10 millimeters.

6. The shoe of claim 1 wherein the median midsole thickness is at least 15 millimeters.

7. The shoe of claim 1 wherein the midsole is bonded to neither the upper nor outsole, to facilitate ready removal of the midsole.

8. The shoe of claim 1 wherein the heel counter and the midsole are of a unitary one-piece construction that is removable from the interior of the upper.

9. The shoe of claim 1 wherein a portion of the midsole is visible from the exterior of the shoe via a window in a sidewall of the upper.

10. A shoe comprising:

an outsole;

an upper having a bottom peripheral edge, the upper being secured directly to the outsole around substantially the entire bottom peripheral edge;

a midsole within an interior of the upper, the midsole having a forward end and a rearward end spaced from the forward end; and a heel counter extending upwardly from a portion of the rearward end of the midsole, the heel counter being adapted for cradling the shoe wearer's heel when the shoe wearer is wearing the shoe, the midsole and the heel counter being integral with one another.

11. The shoe of claim 10 wherein the midsole and the heel counter are of a monolithic construction that is removable from the interior of the upper.

12. The shoe of claim 11 wherein the midsole has a medial side edge and a lateral side edge spaced laterally from the medial side edge, the medial and lateral side edges extending from the rearward end of the midsole to the forward end of the midsole, the midsole having a centerline defined by a locus of points midway between the medial side edge and the lateral side edge as the medial and lateral side edges extend from the rearward end of the midsole to the forward end of the midsole, the midsole having a medial side region adjacent the medial side edge, a lateral side region adjacent the lateral side edge, and a central region between the medial and lateral side regions, the medial side region, lateral side region and central region each extending from the rearward end of the midsole to the forward end of the midsole, a width of the central region intersected by any plane perpendicular to the centerline being equal to a width of the medial side region intersected by such plane and equal to a width of the later al side region intersected by such plane, the central region of the midsole having a top surface and a bottom surface, the top and bottom surface s of the central region extending from the rearward end of the midsole to the forward end of the midsole;

the outsole having a bottom surface with a central section that is generally coextensive with the central region of the midsole;

the shoe having a median sole thickness defined by the median distance between the top surface of the central region of the midsole and the central section of the bottom surface of the outsole;

the central region of the midsole having a median midsole thickness defined by the median distance between the top surface of the central region of the midsole and the bottom surface of the central region of the midsole, the median midsole thickness being at least half the median sole thickness.

13. The shoe of claim 12 wherein the median midsole thickness is at least 60% of the median sole thickness.

14. The shoe of claim 12 wherein a first mean thickness is defined by the mean distance between the top surface of the central region of the midsole and the central section of the bottom surface of the outsole, and wherein a second mean thickness is defined by the mean distance between the top surface of the central region of the midsole and the bottom surface of the central region of the midsole, the second mean thickness being at least half the first mean thickness.

15. The shoe of claim 14 wherein the second mean thickness is at least 60% of the first mean thickness.

16. The shoe of claim 12 wherein a portion of the midsole is visible from the exterior of the shoe via a window in a sidewall of the upper.

17. A shoe comprising:

an outsole;

an upper having a base portion defined by a bottom peripheral edge of the upper, the upper being secured directly to the outsole around substantially the entire bottom peripheral edge; and a midsole positioned within an interior of the upper above the base portion of the upper, the midsole having a forward end and a rearward end spaced from the forward end, a portion of the midsole being visible from the exterior of the shoe via a window in a sidewall of the upper.

18. The shoe of claim 15 further comprising a heel counter extending upwardly from a portion of the rearward end of the midsole, the heel counter being adapted for cradling the shoe wearer's heel when the shoe wearer is wearing the shoe, the midsole and the heel counter being integral with one another.

19. The shoe of claim 18 wherein the midsole has a medial side edge and a lateral side edge spaced laterally from the medial side edge, the medial and lateral side edges extending from the rearward end of the midsole to the forward end of the midsole, the midsole having a centerline defined by a locus of points midway between the medial side edge and the lateral side edge as the medial and lateral side edges extend from the rearward end of the midsole to the forward end of the midsole, the midsole having a medial side region adjacent the medial side edge, a lateral side region adjacent the lateral side edge, and a central region between the medial and lateral side regions, the medial side region, lateral side region and central region each extending from the rearward end of the midsole to the forward end of the midsole, a width of the central region intersected by any plane perpendicular to the centerline being equal to a width of the medial side region intersected by such plane and equal to a width of the lateral side region intersected by such plane, the central region of the midsole having a top surface and a bottom surface, the top and bottom surfaces of the central region extending from the rearward end of the midsole to the forward end of the midsole, the central section of the bottom surface of the outsole being generally co-extensive with the central region of the midsole;

the shoe having a median sole thickness defined by the median distance between the top surface of the central region of the midsole and a central section of the bottom surface of the outsole;

the central region of the midsole having a median midsole thickness defined by the median distance between the top surface of the central region of the midsole and the bottom surface of the central region of the midsole, the median midsole thickness being at least half the median sole thickness.

* * * * *